US010011397B2

(12) United States Patent
Ausnit et al.

(10) Patent No.: US 10,011,397 B2
(45) Date of Patent: Jul. 3, 2018

(54) ENHANCEMENTS TO SPACED MULTI-RIB CLOSURE

(71) Applicants: Steven Ausnit, New York, NY (US); Eric Plourde, Frankfort, IL (US)

(72) Inventors: Steven Ausnit, New York, NY (US); Eric Plourde, Frankfort, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 15/308,218

(22) PCT Filed: May 19, 2015

(86) PCT No.: PCT/US2015/031519
§ 371 (c)(1),
(2) Date: Nov. 1, 2016

(87) PCT Pub. No.: WO2015/179365
PCT Pub. Date: Nov. 26, 2015

(65) Prior Publication Data

US 2017/0081085 A1 Mar. 23, 2017

Related U.S. Application Data

(60) Provisional application No. 62/000,194, filed on May 19, 2014.

(51) Int. Cl.
*B65D 33/25* (2006.01)
*B65D 75/58* (2006.01)

(52) U.S. Cl.
CPC ..... *B65D 33/2566* (2013.01); *B65D 33/2525* (2013.01); *B65D 33/2533* (2013.01); *B65D 75/5805* (2013.01)

(58) Field of Classification Search
CPC ..... B65D 33/2566; B65D 33/2525; B65D 33/2533; B65D 75/5805
See application file for complete search history.

(56) References Cited

U.S. PATENT DOCUMENTS

| | | | | |
|---|---|---|---|---|
| 6,427,840 | B1 * | 8/2002 | Flacker | B65D 75/002 206/387.1 |
| 2002/0152723 | A1 | 10/2002 | Ausnit | |
| 2003/0215163 | A1 | 11/2003 | Schneider et al. | |
| 2006/0162289 | A1 | 7/2006 | Shepard et al. | |
| 2015/0225159 | A1 * | 8/2015 | Gruterich | B65D 33/16 383/208 |

FOREIGN PATENT DOCUMENTS

| | | |
|---|---|---|
| EP | 0443867 | 8/1991 |
| WO | 2012/073999 | 6/2012 |

OTHER PUBLICATIONS

International Search Report issued in PCT/US2015/031519 dated Aug. 14, 2015.

* cited by examiner

*Primary Examiner* — Corey Skurdal
(74) *Attorney, Agent, or Firm* — McCarter & English, LLP

(57) ABSTRACT

The present disclosure relates to spaced multi-rib zippers, reclosures or closures for flexible packaging, wherein openings or lines of weakness are created between rows of mating elements.

22 Claims, 1 Drawing Sheet

ENHANCEMENTS TO SPACED MULTI-RIB CLOSURE

This application is a National Phase Application of PCT International Application No.: PCT/US2015/031519, filed on May 19, 2015, which claims priority under 35 U.S.C. 119(e) of U.S. provisional application Ser. No. 62/000,194, filed on May 19, 2014, the contents of which is hereby incorporated by reference in its entirety and for all purposes.

BACKGROUND OF THE DISCLOSURE

Field of the Disclosure

The present disclosure relates to closures for flexible packaging, particularly those with openings or lines of weakness created between rows of mating elements.

Description of the Prior Art

The prior art includes various multi-rib closure strips for reclosable flexible packages. The prior art includes U.S. Published Patent Application 2013/0305500 entitled "Spaced Multi-Rib Zipper", published on Nov. 21, 2013 on behalf of Septien Rojas et al.; and U.S. Published Patent Application 2013/0209000 entitled "Easy Open and Reclosable Package with Die-Cut Web and Reclosure Mechanism", published on Aug. 15, 2013 to Owensby et al. Alternatives to the current method of slitting a multi-rib zipper or closure, or feeding two separate zipper or closure strips, are envisioned. In particular, feeding and sealing a single strip to a web would typically simplify production of reclosable packages.

OBJECTS AND SUMMARY OF THE DISCLOSURE

It is therefore an object of the present disclosure to provide a method of production of multi-rib zippers or closures, wherein feeding and sealing of a single strip to a web is involved.

This and other objects are attained by a zipper, reclosure or closure with two sets of mating elements. Each set of mating elements typically includes a plurality of mating elements thereby creating a multi-alignment zipper, reclosure or closure. Openings are formed between the rows of mating elements in the zipper or closure such that when the zipper or closure is applied to the web or film there is an opening already created for the product to be retrieved through, or there is a perforated panel that can be removed to gain access to the product.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
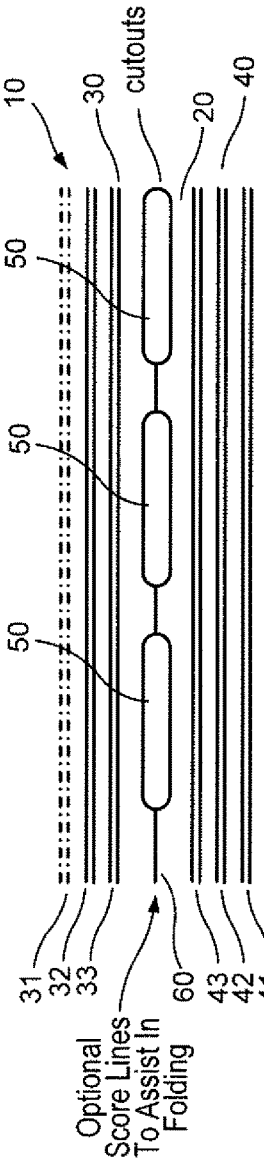
FIG. 1 Is a top view of a first embodiment of zipper or closure of the present disclosure.

Referring now to the drawings in detail wherein like numeral refer to like elements throughout the several views, one sees that FIG. 1 discloses a spaced multi-rib closure strip (or zipper) 10 which is typically made from polymeric material. Multi-rib closure strip 10 includes a base 20, a first set (or plurality) of spaced multiple mating elements or ribs 30, comprising ribs 31, 32, 33 and a second set (or plurality) of spaced multiple mating elements or ribs 40, comprising ribs 41, 42, 43. It is noted that rib 31 is shown in phantom throughout the various figures to illustrate that some embodiments would include two ribs in the first set of spaced multiple mating elements or ribs 30, and other embodiments would include three ribs. It is envisioned that different embodiments could include a different number of ribs. Additionally, the first and second sets of multiple mating elements or ribs 30, 40 could be Aplix® or Velcro® (hook-and-eye) configurations.

Figure 3:
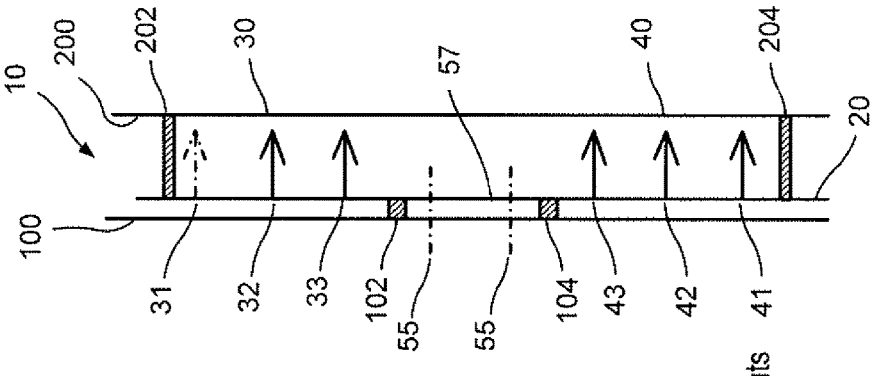
FIG. 3 is a cross-sectional view along plane 3-3 of FIG. 2.

Oval-shaped openings 50 are created at periodic intervals along the central longitudinal axis of base 20, between the first and second sets of spaced multiple mating elements or ribs 30, 40. Moreover, the major axes of the oval-shaped openings align with or are formed along the central longitudinal axis of the base 20. Therefore, when the closure strip 10 is applied as shown in U.S. Published Patent Application 2013/0209000, there is an opening already created for the product to be retrieved through, or there is a perforated panel that can be removed to gain access to the product. Similarly, the openings 50 of FIG. 1 or the panels 55 of FIG. 2 could be rectangular. The openings 50 (FIG. 1) or the perforations (or other lines of weakness, such as, but not limited to, score lines defining a weakened periphery) 55 with panel 57 formed therewithin (FIG. 2) are typically produced just upstream of the application step thereby typically achieving simplified registration but this could also be done in an earlier process. FIG. 3 is a cross-sectional view of the spaced multi-rib closure strip (or zipper) 10 of FIG. 2. Typically, in the embodiment of FIG. 1, the length of the openings 50 exceeds the distance between the openings 50. Similarly, typically, in the embodiment of FIG. 2, the length of the panels 57 exceeds the distance between the panels 57.

Figure 2:
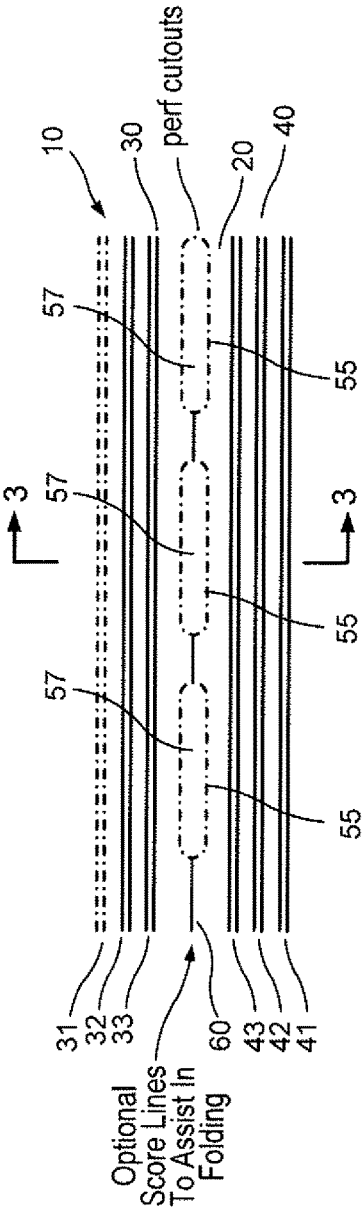
FIG. 2 is a top view of a second embodiment of the zipper of closure of the present disclosure.

Further, as shown in both FIGS. 1 and 2, score lines 60 (or similar lines of weakness, such as perforations) may optionally be incorporated into portions of the central longitudinal axis of base 20 aligned with the openings 50 or perforations 55 so that when the closure 10 is folded along its longitudinal axis, the first and second sets of multiple mating elements or ribs 30, 40 are easily aligned and interengaged or interlocked with each other.

Additionally, it is envisioned that some embodiments could omit the openings 50 of FIG. 1 but retain the scored line 60 or similar line of weakness along the central longitudinal axis of the base 20.

Further, another feature could be to seal the removable patch of U.S. Published Patent Application 2013/0209000 to the perforated/scored panels 55 of FIG. 2 herein so that when the patch is removed, it also removes the perforated/scored panels 55, thereby eliminating the need to remove the perforated/scored panels 55 during the manufacturing process.

FIG. 3 illustrates how the closure 10 could be attached to a package, bag or similar container. Peel seals 102, 104 are positioned outwardly adjacent from perforated or scored panels 55 and attach the closure 10 to a rear wall 100. Similarly, hard seals 202, 204 are formed at the ends of closure 10 and attach the closure 10 to the front wall 200. Hard seals 202, 204 are illustrated as exaggerated in the horizontal direction and are envisioned to be ordinary hard seals. Peel seals 102, 104 could each be a single strip of peel seal material that extends across the entire width of the bag. Alternately, there could be an embodiment with peel seal 102 replaced by a hard seal because accessing the product compartment above the closure 10 typically is not necessary in many designs of reclosable packages.

The present disclosure allows for a single strip to be fed into a packaging machine so that it can be folded to mate onto itself in a lengthwise direction, but with a pre-cut opening between the mating closure elements.

Further advantages of the disclosure are that feeding and sealing a single strip is much easier than feeding and aligning multiple strips. Further, having a score line will typically improve the ease of aligning the mating elements or ribs. Further, having the perforated section removed with the removal of the patch eliminates the need to remove it during the manufacture of the package or closure strip.

Thus the several aforementioned objects and advantages are most effectively attained. Although preferred embodiments of the invention have been disclosed and described in detail herein, it should be understood that this invention is in no sense limited thereby.

What is claimed is:

1. A reclosure for flexible packaging, including:

a base;

a first plurality of mating elements extending from the base, wherein the first plurality of mating elements are parallel to each other;

a second plurality of mating elements extending from the base, wherein the second plurality of mating elements are parallel to each other and parallel to the first plurality of mating elements;

the first plurality of mating elements being separated from the second plurality of mating elements by an area on the base; and the area on the base including a plurality of openings, created by removal of a least one removable portion defined by weakened peripheries.

2. The reclosure of claim 1 wherein the plurality of openings are periodically spaced along a central longitudinal axis of the base.

3. The reclosure of claim 2 wherein the openings are oval-shaped.

4. The reclosure of claim 3 wherein a major axis of the oval-shaped openings aligns with the central longitudinal axis of the base.

5. The reclosure of claim 4 wherein a score line is formed along the central longitudinal axis of the base.

6. The reclosure of claim 1 wherein the reclosure is formed from polymeric material.

7. The reclosure of claim 1 wherein the mating elements include engaging hooks.

8. The reclosure of claim 1 wherein the first set of mating elements engages the second set of mating elements when the reclosure is folded.

9. The reclosure of claim 1 wherein the length of the openings exceeds the distance between the openings.

10. The reclosure of claim 1 wherein the openings are rectangular.

11. A reclosure for flexible packaging, including:

a base;

a first plurality of mating elements extending from the base, wherein the first plurality of mating elements are parallel to each other;

a second plurality of mating elements extending from the base, wherein the second plurality of mating elements are parallel to each other and parallel to the first plurality of mating elements;

the first plurality of mating elements being separated from the second plurality of mating elements by an area on the base; and the area on the base including a plurality of removable portions defined by weakened peripheries.

12. The reclosure of claim 11 wherein the plurality of removable portions are periodically spaced along a central longitudinal axis of the base.

13. The reclosure of claim 12 wherein the removable portions are oval-shaped.

14. The reclosure of claim 13 wherein a major axis of the oval-shaped removable portions aligns with the central longitudinal axis of the base.

15. The reclosure of claim 14 wherein a score line is formed along the central longitudinal axis of the base.

16. The reclosure of claim 11 wherein the weakened peripheries are formed by scoring.

17. The reclosure of claim 11 wherein the weakened peripheries are formed by perforations.

18. The reclosure of claim 11 wherein the reclosure is formed from polymeric material.

19. The reclosure of claim 11 wherein the mating elements include engaging hooks.

20. The reclosure of claim 11 wherein the first set of mating elements engages the second set of mating elements when the reclosure is folded.

21. The reclosure of claim 11 wherein the length of the removable portions exceeds the distance between the removable portions.

22. The reclosure of claim 11 wherein the removable portions are rectangular.

* * * * *